United States Patent [19]

Belanger

[11] 4,055,028

[45] Oct. 25, 1977

[54] REPLACEABLE, ONE PIECE, HINGE-TYPE, SLOT-ENGAGING PACK UNIT

[75] Inventor: James A. Belanger, Northville, Mich.

[73] Assignee: Belanger, Inc., Northville, Mich.

[21] Appl. No.: 680,838

[22] Filed: Apr. 28, 1976

[51] Int. Cl.[2] ..... B24D 13/06

[52] U.S. Cl. ..... 51/334; 15/183; 15/230.19; 51/337

[58] Field of Search ..... 51/334–337, 51/394; 15/230.14, 230.16, 183, 179, 229 B, 230.19

[56] References Cited

U.S. PATENT DOCUMENTS

| | | | |
|---|---|---|---|
| 2,441,536 | 5/1948 | Simon | 15/230.16 |
| 2,653,340 | 9/1953 | Cave | 15/183 X |
| 2,804,730 | 9/1957 | Block | 51/337 |
| 3,058,269 | 10/1962 | Block | 51/337 |
| 3,111,700 | 11/1963 | O'Brien | 15/229 B |
| 3,693,206 | 9/1972 | Tatara | 15/230.14 X |
| 3,967,418 | 7/1976 | Schaffner | 51/334 |

*Primary Examiner*—Al Lawrence Smith
*Assistant Examiner*—Nicholas P. Godici
*Attorney, Agent, or Firm*—Cullen, Settle, Sloman & Cantor

[57] ABSTRACT

A modular pack unit is adapted to be replaceably mounted to a support structure having one or more quasi-cylindrical, key-hole-type, slot-defining formations disposed parallel to the longitudinal axis of the support structure. The pack unit includes a substantially solid, elongated, head-forming and pack-reinforcing support element made from a resiliently firm yet flexible material including a generally cylindrical, solid, bulb-like portion having an integrally formed, radially outwardly extending solid fin portion. A first sheet or ply of generally flexible material has a first portion draped or looped tightly over the elongated element so as to conform closely to the contours thereof and a second portion extending outwardly from the support element. The looped portion has a first section closely overlying the bulb-like portion and second and third sections integrally contiguous with the respective opposite ends of the first section tightly overlying corresponding opposite sides of the fin portion. The second section, fin portion, and third section are securely fastened together in a sandwich fashion as by sewing, stapling, chemical or mechanical bonding to prevent relative sliding movement between the elongated support element and the first portion of the first sheet and to form a generally cylindrical, flexible material-covered, bulbous head and corresponding neck portion for the pack unit which is adapted to be telescopically received within a support slot for replaceably mounting the pack unit thereto.

26 Claims, 6 Drawing Figures

REPLACEABLE, ONE PIECE, HINGE-TYPE, SLOT-ENGAGING PACK UNIT

BACKGROUND OF THE INVENTION

1. Field of The Invention

The present invention relates generally to an improved pack unit for rotary finishing wheels, car wash curtains and the like, and more particularly to a replaceable, one piece, hinge-type, slot-engaging pack unit which can be replaceably mounted on either a curtain-forming structure or a rotary finishing wheel without the use of rod elements or intermediate slot-engaging clip members.

The invention finds use in any type of rotary finishing wheel structure such as those employing abrasive sheets, bristles, or the like which are generally used for grinding, rough or finish abrasive working, brushing, burnishing, and the like. However, in the preferred embodiment of this invention, the improved pack units are employed in commercial automotive car washing establishments for replaceable mounting to form curtain structures or finishing wheel structures, either of which may serve in washing, drying, buffing, polishing, or otherwise finishing the car.

2. Description of The Prior Art

My own U.S. Patents are typical of the rotary finishing wheel structures and pack units of the prior art to which this invention relates and the numbers and issue dates of those patents are as follows: 3,455,068, July 15, 1969; 3,535,833, Oct. 27, 1970; 3,621,622, Nov. 23, 1971; 3,626,646, Dec. 14, 1971; 3,685,217, Aug. 22, 1972; 3,768,214, Oct. 30, 1973; 3,772,833, Nov. 20, 1973; 3,798,847, Mar. 26, 1974; 3,800,481, Apr. 2, 1974; 3,807,099, Apr. 30, 1974; 3,813,829, June 4, 1974; 3,820,291, June 28, 1974; 3,842,547, Oct. 22, 1974; 3,914,908, Oct. 28, 1975; and Re 28,118, Aug. 20, 1974.

Generally, the pack units of the prior art have been replaceably attached to the finishing wheel structure by sliding an elongated rod through a clamp member fastened to the finishing material portion of the pack unit or through a bight portion of one or more of the plies of the pack unit, the bight portion often containing a cylindrical rod-receiving tube or U-shaped rod-receiving member. While a few of the pack units of the prior art are adapted to directly engage a slot on the periphery of the wheel, all of these pack units require an external clamping member having one portion for securing the flaplike plies of finishing material together and a second portion adapted for engaging the slots of the wheel.

Both the mounting means which requires an insertable rod and usually a rod-receiving clamp member secured to the flap-like pad members and the technique which requires a separate, normally metallic, clamp member, one end of which secures the flap-like finishing pads while the other end is adapted to engage the slot, are relatively expensive and it is often difficult or time-consuming to replace the pack units.

The improved modular pack unit of the present invention employs a relatively inexpensive, easy to replace construction which does not employ any type of external clamping member and does not require the use of insertable mounting rods or the like.

SUMMARY OF THE INVENTION

The improved one piece, hinge-type, slot-engaging modular pack unit of the present invention is a relatively inexpensive, easily replaceable pack unit which is adapted to be mounted without the use of inserable rods and which does not employ complex external clamping mechanisms having one end adapted to secure the flap-like pad of finishing material together and its opposite end adapted to be retained within a slot either by means of its basic structure or by use of an insertable rod.

The improved pack unit of the present invention is adapted to be replaceably mounted to a support structure having one or more quasi-cylindrical key-hole-type, slot-defining formations disposed parallel to the longitudinal axis of the support structure. The support structure can be adapted to suspend one or more of the pack units to form a curtain arrangement or it may be in the form of a rotary hub adapted to form a finishing wheel or similar structure.

The improved pack unit includes a substantially solid, elongated head-forming and pack-reinforcing support element including a generally cylindrical, bulb-like portion having an integrally formed, radially outwardly extending fin portion. A first sheet or ply of generally flexible material, which may or may not be used as a portion of the unit of finishing material, has a first portion draped or looped tightly over the elongated element so as to conform closely to the contours thereof and a second portion extending outwardly from the element. The looped portion has a first section closely overlying the bulb-like portion and a second and third section integrally contiguous with the respective opposite ends of the first section tightly overlying corresponding opposite sides of the fin portion. The second section, fin portion and third section are securely fastened together in a sandwich fashion as by sewing, stapling, chemical or mechanical bonding or the like so as to prevent relative sliding movement between the elongated support element and the first portion of the first sheet and to form a generally cylindrical, flexible material-covered, bulbous head and corresponding neck portion for said pack unit which is adapted to be telescopically received within a support slot for replaceably mounting the pack unit thereto for limited hinge-type, pivotal rotation about an axis parallel to the longitudinal support axis.

One or more flap-like flexible units of finishing material such as cloth, cloth-like material, felt-like material, leather, sewed sisal, pex, horsehair or similar bristles, coated abrasive sheets or the like are provided. Each flaplike unit has an inner portion adapted to be secured, either replaceably or permanently, to the second or similar portion of the first sheet and an outer portion adapted to engage a workpiece for washing, drying, buffing, polishing or otherwise finishing the workpiece, as known in the art.

A major feature of the present invention resides in the fact that no replaceably insertable rod is required for mounting the improved pack unit of this invention. Similarly, the improved pack unit does not require a relatively costly, specially configured, generally rigid, external clamping member having its clamping end rigidly secured to the unit of flap-like finishing members and its opposite end specially configured for slot engagement or for engagement by an insertable rod-like member.

It is a feature of this invention to form an improved pack unit having an integral bulbous head and neck portion adapted to be telescopically received replaceably within a slot to allow limited, flap-like pivotable rotation of the pack unit with respect to a slot axis parallel to the support axis.

It is another feature of this invention to construct or form the bulbous head and neck portion by tightly looping a sheet of flexible material over an elongated support element to which it may be mechanically or chemically secured. The elongated support element may be a relatively inexpensive, extruded piece of plastic material which provides a sufficiently solid structure about which to form the required slot-engaging head and neck portion of the pack unit.

It is another feature of this invention to provide such a pack unit wherein the portion of the sheet of material which is looped over the support element and conforms closely to the contours thereof may be secured thereto by sewing, by stapling, by chemical or mechanical bonding, or the like. Additionally, the sheet of material which forms the loop may itself serve as one of the flaplike finishing members. Additional flap-like units of finishing material may be secured to one or both sides of a portion of the flexible sheet extending from the looped portion or from one or both surfaces of both portions of the flexible sheet extending outwardly from the looped portion. The additional flap-like finishing material units may be replaceably attached by Velcro fastening means or they may be permanently attached to the flexible sheet or to one another by means of sewing, stapling, chemical or mechanical bonding, or the like.

The improved modular pack units of this invention may be quickly and easily mounted to a longitudinal curtain-forming slot or a peripherally arranged slot on a finishing wheel simply by inserting the material-covered head and neck portion telescopically within the slot and then closing the end of the slot by a face plate, bolt, screw, or similar means to prevent the axial escape of the head portion therefrom. The head portion will be unable to pass radially outwardly through the restricted neck or throat portion of the slot thereby retainably and replaceably mounting the pack unit for limited pivotable motion about an axis parallel to the longitudinal support axis.

Other advantages and meritorious features of the present invention will be more fully understood from the following detailed description of the drawings and the preferred embodiment, the appended claims and the drawings which are described briefly hereinbelow.

DESCRIPTION OF THE PREFERRED EMBODIMENT

Figure 1:
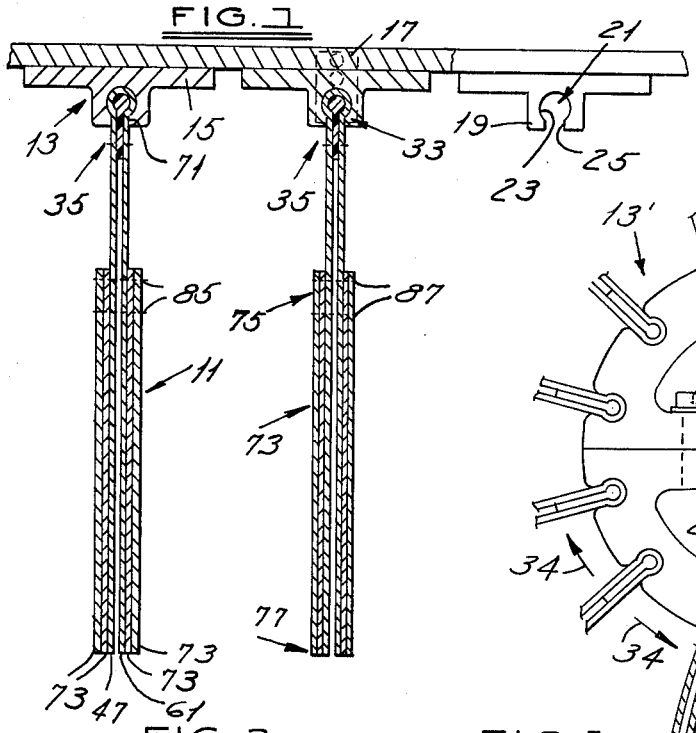
FIG. 1 is a fragmentary end view of a slot-defining support structure having the improved pack units of the present invention replaceably mounted thereon to form a curtain-like structure as often employed in car washing establishments for washing and drying purposes.

FIG. 1 shows one application of the replaceable, one piece, hinge-type, slot-engaging pack unit 11 of the present invention and the support structure 13 therefore. In this application, the support structure 13 includes a plurality of overhead racks 15 which may be made from heavy duty, extruded, tempered aluminum or the like, which replaceably and pivotally mount the pack units 11 so that they are suspended or hung to form a curtain arrangement such as that used for washing or drying in car wash establishments. The overhead racks 15 are secured to an overhead bracket assembly or ceiling unit 17 as by welding, threaded bolt assemblies, or any similar, conventionally known fastening means and each of the racks 15 has a longitudinal support axis which is perpendicular to the plane of the sheet of drawings. Each of the rack units 15 includes a slot-defining structure or formation 19 thereon for defining a quasi-cylindrical, key-hole-type, slot 21 which is disposed parallel to the longitudinal support axis. The elongated slot 21 has a generally cylindrical inner portion 23 which opens radially outward through a restricted neck portion 25.

Figure 2:
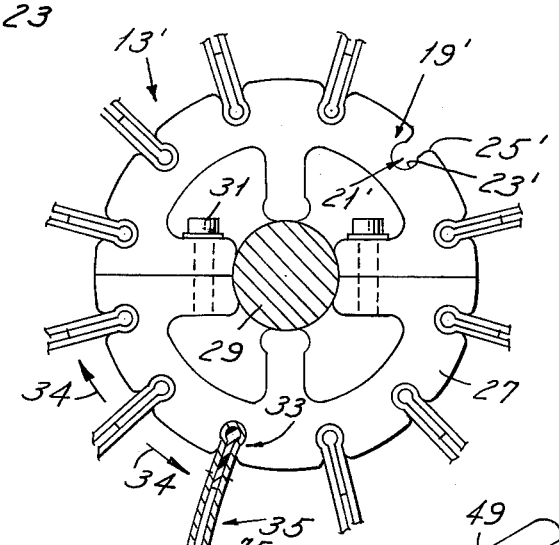
FIG. 2 is a fragmentary axial end view of a typical finishing wheel construction showing a cylindrical hub structure secured to a rotatable shaft and having slot-defining means circumferentially spaced about the periphery thereof for receiving the improved pack units of the present invention.

Similarly, in FIG. 2, the support structure 13' includes a rotary finishing wheel hub 27 which is adapted to be secured to a rotatable shaft 29 as by fastening means 31 for rotation therewith. In the preferred embodiments disclosed herein, the rotating hub portion 27 is a heavy duty, relatively light weight, extruded piece of tempered aluminum although it could also be die cast, or molded of powered metal or plastic material. It could also be molded from a suitable phenolic, a glass-filled nylon, or other rigid thermoplastic or thermosetting material or it could be machined from steel as conventionally known.

A circumferential series of equally spaced, quasi-cylindrical, key-hole-type, slot-defining formations or structures 19', each of which defines or forms an elongated slot 21' having its axis parallel to the longitudinal support axis which is coincident with the axis of rotation of the shaft 29. Each of the slots 21' includes a generally cylindrical inner portion 23' which opens radially outwardly through a restricted neck or throat portion 25'.

Each of the slots 21' is adapted to removeably and replaceably receive, in a sliding manner, the material-covered, bulbous head and neck portion 33 of the mounting end 35 of the pack unit 11 so as to allow for a limited hinge-type or flap-like pivotable motion in the direction given by the arrows 34 in FIG. 2 about the slot axis which is parallel to the longitudinal axis of the support 13'.

Figure 3:
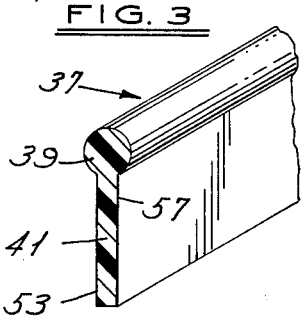
FIG. 3 is a fragmentary perspective view of the substantially solid, elongated, head-forming and pack-reinforcing support element of the present invention.

The mounting end 35 of each of the pack units 11 includes a substantially solid, elongted, head-forming and pack-reinforcing support element 37 as shown in FIG. 3. In the preferred embodiment, the elongated support element 37 is an integrally extruded piece of resiliently firm yet flexible material such as a thermoplastic or thermosetting plastic material such as polyurethane or the like but even an extruded piece of aluminum or the like could be used. The elongated support member 37 includes a generally cylindrical bulb-like portion or bead 39 having a single, substantially flat, integral fin portion or flag 41 extending radially outwardly therefrom.

Figure 5:
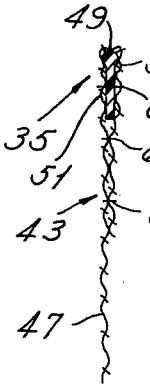
FIG. 5 shows a schematic illustration of the end view of the embodiment of FIG. 4 to illustrate, in cross section, the points at which the stitches are made.
Figure 4:
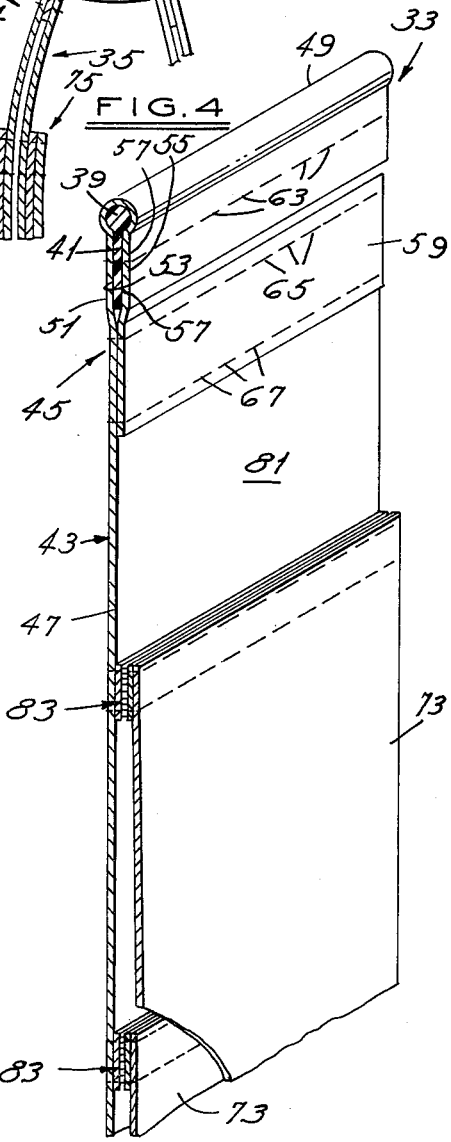
FIG. 4 shows a fragmentary perspective view of one embodiment of the replaceable, one piece, hinge-type slot engaging pack unit of the present invention.

As illustrated in FIGS. 4 and 5, the pack unit 11 has a mounting end 35 which includes a first sheet or ply 43 of relatively flexible, cloth-like material or the like. A first portion 45 of the sheet 43 is draped or looped tightly over the elongated support element 37 so as to conform closely to the contours thereof, and a second portion 47 which is integrally contiguous with the first portion 45 extends generally outwardly from the support element 37.

Figure 6:
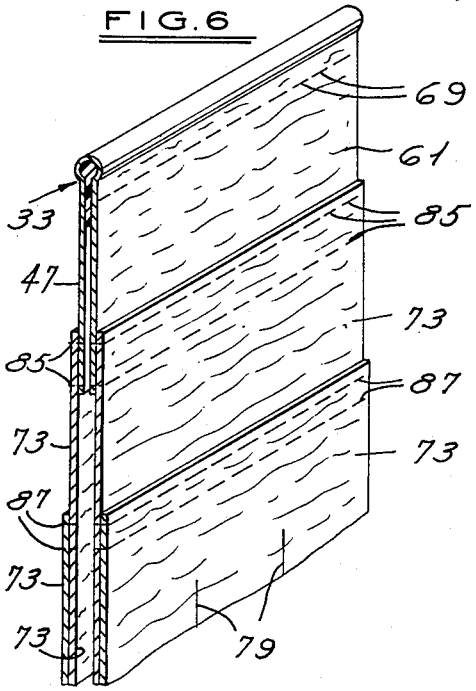
FIG. 6 is a fragmentary perspective view of an alternate embodiment of the replaceable, one piece, hinge-type, slot-engaging pack unit of the present invention.

A first section 49 of the first portion 45 is looped over the generally cylindrical, bulb-like portion 39 of the support element 37 so as to closely overly the contours thereof while a second section 51 integrally contiguous with said first section closely overlies a first outside surface 53 of the fin portion 41 of the support element 37 and then becomes integrally contiguous with the second portion 47 of the sheet 43. A third section 55 is integrally contiguous with the first section 49 and closely overlies and conforms to the opposite outer surface 57 of the fin portion 41 of the elongated element 37. Additionally, an extension 59 of the third section 55 which is integrally contiguous therewith may continue to extend outwardly from the elongated support element 37 as indicated in FIG. 4 or may become integrally contiguous with a third portion 61 which is generally parallel to the second portion 47 as indicated in FIGS. 1, 2, and 6.

With the elongated support element 37 completely covered with the closely contoured sheet material of the first, second, and third sections, 49, 51 and 55, respectively, they may be sewed together as by stitching means 63, represented generally in FIGS. 4 and 5, which completely penetrate the tightly sandwiched combination comprising the second section 51, the substantially flat fin portion 41, and the third section 55 so as to prevent relative sliding motion between the elongated support element 37 and the first sheet 43 and so as to form, in a relatively permanent fashion, the generally cylindrical, materialcovered bulbous head and neck portion 33 of the pack unit 11 which is used to removeably and replaceably mount the pack units 11 in the slots 21 or 21' of the support structures 13 or 13' respectively.

Additionally, a second row of stitches or similar fastening means 65 may be made to directly connect the portions of the second section 51 and third section 55 immediately adjacent to the distal end 67 of the fin member 41 without penetrating the fin member 41 itself so as to further secure the elongated member 37 and maintain the required slot-engaging shape of the mounting end 35. Still further, a third row of stitches may be made further outwardly from the support element 37 to directly connect the outermost portion of the third section extension 59 with that part of the first portion or second portion immediately opposite therefrom.

Any type of mechanical or chemical fastening means may be used to innerconnect the first portion 45 to all or a part of the elongated element 37. As indicated by the reference numerals 69 in FIG. 6, conventional staples have been employed to penetrate the second section, 51 third section 55 and the fin portion 41 so as to secure them tightly together in sandwich fashion. As indicated in FIG. 1, the first portion or at least the inside surfaces of the second and third sections 51 and 55, respectively, may be chemically or mechanically bonded to the elongated support element 37 or at least to the opposite sides of the fin portion 41 thereof as conventionally known and as represented in FIG. 1 by the reference numeral 71.

In addition to the first portion of the flexible sheet which is looped tightly around and secured to the elongated support element 37 to form the bulbous head and neck portion 33 of the mounting end 35 of the pack unit 11 and the second portion 47 of FIG. 4 or the second portion 47 and third portion 61 of FIGS. 1, 2 and 6, the pack unit 11 of the present invention includes one or more flap-like units or members 73 of finishing material having an inner portion 75 adapted to be secured to the first sheet 43 and an outer portion 77 adapted to engage a workpiece for performing a finishing-type operation thereon.

For the purposes of this invention, the term finishing or finishing operation is used in a generic sense to refer to any conventionally known type of operation such as abrading, burnishing, polishing, buffing, washing, waxing, drying, or the like. In the preferred embodiment of the present invention, which is used in car wash applications, the finishing material of the flap-like units 73 would preferably be cloth, cloth-like material, felt-like material or the like but in other examples sewed sisal or cloth, pex, horsehair or leather could be used. For abrading type applications, flexible abrasive sheets, sewed packs of bristle material, leaves of flexible sheet material coated with abrasive grains or the like could be used as conventionally known. Similarly, as preferred in many finishing applications, the flap-like units 73 or the sheets or pads thereof may be provided with a plurality of spaced slits 79 extending generally perpendicular to the longitudinal support axis.

As indicated in FIG. 4, the second portion 47 of the first sheet 43 may extend outwardly from the elongated support element 37 and may have one of its surfaces 81 adapted to have a plurality of flap-like units 73 removeably secured thereto as by Velcro type fasteners 83 or the like so that the outward ends of the removeably secured flap-like units 73 may overlap outwardly attached flap-like units 73 as illustrated in FIG. 4. The major advantage of the removeable fastening means 83 lies in the fact that individual ones of the flap-like units 73 may be replaced, for example, when they become too wet for drying purposes or the like with ease in many applications.

The embodiments of FIGS. 1, 2, and 6 show that the first sheet 43 is looped generally centrally over the elongated support element 37 so that both a second portion 47 and a parallel third portion 61 extend outwardly from the bulbous head and neck portion 33. As indicated in FIGS. 1 and 2, the flexible material of which the first sheet 43 is made may be similar to the material of the flap-like units 73 or at least the outer portion 77 thereof such that the outermost ends of the second portion 47 and the third portion 61 may be coterminous with the outermost end of the outer portion 77 and adapted for similarly operatively engaging the workpiece for finishing the same.

Layers of the flap-like units 73 may be disposed against the outside surface of the third portion 61 and against the outside surface of the second portion 47 and then mechanically attached in a tight sandwich-type formation as by stitches 85 or staples 87 or any similar mechanical fastening or chemical or mechanical bonding means conventionally known or by the removeably Velcro-type fasteners 83 of FIG. 4.

FIG. 6 shows the first sheet 43 having its opposite ends 47 and 61 distending outwardly from the elongated support element 37. In FIG. 6, the outermost ends of the second section 47 and the third section 61 are not coterminous with the ends of the flap-like units 73. Instead, a first pair of flap-like units 73 is secured to the first sheet 43 so that one of the flap-like units 73 is securely attached to the outside surface of the second portion 47 adjacent the end thereof while the second flap-like unit 73 of the first pair is securely attached to the outside surface of the third portion 61 adjacent the end thereof so that the pair of flap-like members 73 are secured directly opposite one another as by the stitches 85 so as to overlap the respective portions 47 and 61 without forming a complete sandwich-like structure thereof. A second pair of flap-like units 73 is then secured in an overlapping manner to the outer surfaces of the first pair of flap-like units 73 by any of the fastening means known in the art, for example, as by staples 87. Additional pairs of flap-like units 73 may be attached to opposite outer portions of the previously attached inward pair of flap-like pack units 73 and so on to form a progressively thicker, outwardly expanding pack unit 11. It would, of course, also be possible to continue to outwardly attach flap-like units in an overlapping manner without attaching them opposite one another so as to achieve a staggered effect if desired.

Regardless of which of the embodiments of the present invention is employed, and improved, relatively low cost, unitary pack unit 11 is formed which has a flexible material-covered bulbous head and neck portion 33 adapted to be directly telescopically received in the slots 21 or 21' so as to replaceably and pivotally mount the pack unit 11 without requiring individual rod-like inserts or complex, specially configured clamp units adapted for mounting the flaplike units 73 to the support structure 13 as were previously required.

With this detailed description of the specific apparatus used to illustrate the prime embodiment of the present invention and the operation thereof, it will be obvious to those skilled in the art that various modifications can be made in the structures, materials, and usages recited herein without departing from the spirit and scope of the present invention which is limited only by the appended claims.

I claim:

1. A pack unit adapted to be replaceably mounted to a support structure having a quasi-cylindrical, key-hole-type, slot-defining means disposed parallel to the longitudinal axis of the support structure, the slot having a generally cylindrical inner portion opening radially outwardly through a restricted neck portion, said pack unit comprising a substantially solid, elongated, head-forming and pack reinforcing support element made from a resiliently firm yet flexible plastic material, said support element including a generally cylindrical, solid, bulb-like portion having a single, substantially flat, integral, solid fin portion of rectangular configuration extending radially outwardly therefrom, a first sheet of generally flexible material having one portion looped tightly over said elongated support element so as to conform closely to the contours thereof and a second portion extending outwardly from said support element, said looped portion having a first section closely overlying said bulb-like portion and second and third sections integrally contiguous with the respective opposite ends of said first section tightly overlying corresponding opposite sides of said fin portion, fastening means extending completely through said second and third sections of the first portion of said first sheet and the fin portion of said support element for securing the looped portion of said first sheet to said elongated support element to prevent relative sliding movement therebetween and forming a generally cylindrical, flexible material covered, bulbous head and neck portion of said pack unit which is adapted to be telescopically received within said support slot for replaceably mounting said pack unit thereto, and a flap-like unit of finishing material having an inner portion adapted to be secured to the second portion of said first sheet and an outer portion adapted to engage a workpiece for performing a finishing operation thereon.

2. The pack unit of claim 1 further characterized in that said fastening means including stitching means completely penetrating the sandwiched combination of said second section, said fin portion and said third section to prevent relative sliding movement between said flexible material-covered, elongated element and said first portion of said first sheet while simultaneously forming the slot-engaging head and neck portion of said pack unit.

3. The pack unit of claim 2 further characterized in that said pack unit includes additional stitching means for securely connecting said second section directly to said third section immediately adjacent the end of said fin portion without penetrating said fin portion.

4. The pack unit of claim 3 further characterized in that said additional stitching means also securely connects said second and third sections directly together outwardly of the end of said fin portion.

5. The pack unit of claim 1 further characterized in that said fastening means includes staples completely penetrating the sandwiched combination of said second section, said fin portion and said third section to prevent relative sliding movement between said flexible material covered elongated element and said first portion of said first sheet while simultaneously forming the slot-engaging head and neck portions of said pack unit.

6. The pack unit of claim 1 further characterized in that said fastening means includes chemical bonding means for tightly securing at least said second section, said fin portion and said third section to form a sandwiched combination with no relative sliding movement between said flexible material-covered elongated element and said first sheet while forming the slot-engaging head and neck portions of said pack unit.

7. The pack unit of claim 1 further characterized in that said fastening means includes mechanical bonding means for tightly securing at least said second section, said fin portion and said third second to form a sandwiched combination with no relative sliding movement between said flexible material-covered elongated element and said first sheet while forming the slot-engaging head and neck portions of said pack unit.

8. The pack unit of claim 1 further characterized in that said plastic material is a thermoplastic or thermosetting plastic material such as polyurethane or the like.

9. The pack unit of claim 1 further characterized in that said pack unit includes a plurality of said flap-like units of finishing material.

10. The pack unit of claim 9 further characterized in that the outwardly extending second portion of said first sheet has at least a first and second of said flap-like units secured to a single surface thereof in an overlapping manner.

11. The pack unit of claim 10 further characterized in that each of said flap-like units includes at least one flexible ply of finishing material having a plurality of spaced slits generally normal to said support axis and disposed substantially across the width thereof.

12. The pack unit of claim 10 further characterized in that said flap-like units may be secured to said single surface of said second portion in a removeable and replaceable manner.

13. The pack unit of claim 12 further characterized in that each of said flap-like units includes at least one ply having a plurality of spaced parallel slits arranged substantially across the width thereof, said slits being generally perpendicular to said support axis.

14. The pack unit of claim 9 further characterized in that said second portion of said first sheet is integrally contiguous with said second section of said looped portion and extends outwardly from said elongated support element in a direction generally parallel to the plane of said fin portion, said first sheet includes a third portion which is integrally contiguous with said third section of said looped portion and extends outwardly from said elongated support element, said third portion being arranged parallel to said second portion, said flap-like units of finishing material being secured to both said second and third portions.

15. The pack unit of claim 14 further characterized in that said flap-like units are secured in pairs to the opposite outer surfaces of said second and third portions.

16. The pack unit of claim 15 further characterized in that a first flap-like unit is secured in an overlapping manner to the outer surface of said second portion and a second flap-like unit is secured in an overlapping manner to the outer surface of said third portion opposite said first flap-like unit.

17. The pack unit of claim 16 further characterized in that a third flap-like unit is secured in an overlapping manner to the outer surface of said first flap-like unit and a corresponding fourth flap-like unit is secured in an overlapping manner to the outer surface of said second flap-like unit opposite said third flap-like unit.

18. A pack unit adapted to be replaceably mounted to a support structure having a quasi-cylindrical, key-hole-type, slot-defining means disposed parallel to the longitudinal axis of the support structure, the slot having a generally cylindrical inner portion opening radially outwardly through a restricted neck portion, said pack unit comprising a substantially solid, elongated, head-forming and pack reinforcing support element including a generally cylindrical, bulb-like portion having a single, substantially flat, integral fin portion extending radially outwardly therefrom, a first sheet of generally flexible material having one portion looped tightly over said elongated support element so as to conform closely to the contours thereof and second and third portions extending outwardly from said support element, said looped portion having a first section closely overlying said bulb-like portion and second and third sections integrally contiguous with the respective opposite ends of said first section tightly overlying corresponding opposite sides of said fin portion, fastening means for securing the looped portion of said first sheet to said elongated support element to prevent relative sliding movement therebetween and to form a generally cylindrical, flexible material covered, bulbous head and neck portion of said pack unit which is adapted to be telescopically received within said support slot for replaceably mounting said pack unit thereto, said second portion of said first sheet being integrally contiguous with said second section of said looped portion and extending outwardly from said elongated support element in a direction generally parallel to the plane of said fin portion and said third portion of said first sheet being integrally contiguous with said third section of said looped portion and extending outwardly from said elongated support element and being arranged parallel to said second portion, a plurality of flap-like units of finishing material, each flap-like unit having inner and outer portions, said flap-like units being disposed on the outer sides of said second and third portions of said first sheet, with the inner portions of said flap-like units being secured to said second and third portions to sandwich said second and third portions between said plurality of flap-like units and with the outer portions of said flap-like units being adapted to engage a workpiece for finishing same, the ends of said second and third portions of said first sheet being generally coterminus with the outer portions of said flap-like units and also being adapted to engage a workpiece for finishing same.

19. The pack unit of claim 18 further characterized in that said flap-like units are secured to said second and third portions by stitching means.

20. The pack unit of claim 18 further characterized in that said flap-like units are secured to said second and third portions by staple means.

21. The pack unit of claim 18 further characterized in that said flap-like units are secured to said second and third portions by chemical bonding means.

22. The pack unit of claim 18 further characterized in that said flap-like units are secured to said second and third portions by mechanical bonding means.

23. A pack unit adapted to be replaceably mounted to a support structure having a quasi-cylindrical, key-hole-type, slot-defining means disposed parallel to the longitudinal axis of the support structure, the slot having a generally cylindrical inner portion opening radially outwardly through a restricted neck portion, said pack unit comprising a substantially solid, elongated, head-forming and pack reinforcing support element including a generally cylindrical, bulb-like portion having a single, substantially flat, integral fin portion extending radially outwardly therefrom, a first sheet of generally flexible material having one portion looped tightly over said elongated support element so as to conform closely to the contours thereof and second and third portions extending outwardly from said support element, said looped portion having a first section closely overlying said bulb-like portion and second and third sections integrally contiguous with the respective opposite ends of said fist section tightly overlying corresponding opposite sides of said fin portion, fastening means for securing the looped portion of said first sheet to said elongated support element to prevent relative sliding movement therebetween and to form a generally cylindrical, flexible material covered, bulbous head and neck portion of said pack unit which is adapted to be telescopically received within said support slot for replaceably mounting said pack unit thereto, said second portion of said first sheet being integrally contiguous with said second section of said looped portion and extending outwardly from said elongated support element in a direction generally parallel to the plane of said fin portion and said third portion of said first sheet being integrally contiguous with said third section of said looped portion and extending outwardly from said elongated support element and being arranged parallel to said second portion, a plurality of flap-like units of finishing material which are detachably secured to said second and third portions of said first sheet, said flap-like units being adapted to be secured to said second and third portions by Velcro fastening means which permits same to be easily removed and replaced.

24. A pack unit adapted to be replaceably mounted to a support structure having a quasi-cylindrical, key-hole-type, slot-defining means disposed parallel to the longitudinal axis of the support structure, the slot having a generally cylindrical inner portion opening radially outwardly through a restricted neck portion, said pack unit comprising a substantially solid, elongated head-forming and pack reinforcing support element made from a resiliently firm yet flexible plastic material, said support element including a generally cylindrical, solid, bulb-like portion having a single, substantially flat, integral, solid fin portion of rectangular configuration extending radially outwardly therefrom, a first sheet of generally flexible material having one portion looped tightly over said elongated support element so as to conform closely to the contours thereof and second and third portions extending outwardly from said support element, said looped portion having a first section closely overlying said bulb-like portion and second and third sections integrally contiguous with the respective opposite ends of said first section tightly overlying corresponding opposite sides of said fin portion, fastening means extending completely through said second and third portions of said first sheet and the fin portion of said support element for securing the looped portion of said first sheet to said elongated support element to prevent relative sliding movement therebetween and forming a generally cylindrical, flexible material covered, bulbous head and neck portion of said pack unit which is adapted to be telescopically received within said support slot for replaceably mounting said pack unit thereto, said second portion of said first sheet being integrally contiguous with said second section of said looped portion and extending outwardly from said elongated support element in a direction generally parallel to the plane of said fin portion and said third portion of said first sheet being integrally contiguous with said third section of said looped portion and extending outwardly from said elongated support element and being arranged parallel to said second portion, a plurality of flap-like units of finishing material, each flap-like unit having inner and outer portions, said flap-like units being disposed on the outer sides of said second and third portions of said first sheet, with the inner portions of said flap-like units being secured to said second and third portions to sandwich said second and third portions between said plurality of flap-like units and with the outer portions of said flap-like units being adapted to engage a workpiece for finishing same.

25. The pack unit of claim 24 wherein the length of said second portion of said first sheet is generally equal to the length of said third portion of said first sheet.

26. The pack unit of claim 25 wherein said second and third portions are secured together by stitching.

* * * * *